United States Patent [19]

Romine

[11] Patent Number: 4,832,820

[45] Date of Patent: May 23, 1989

[54] PRESSURE SETTLING OF MESOPHASE

[75] Inventor: Hugh E. Romine, Ponca City, Okla.

[73] Assignee: Conoco Inc., Ponca City, Okla.

[21] Appl. No.: 135,777

[22] Filed: Dec. 21, 1987

Related U.S. Application Data

[63] Continuation-in-part of Ser. No. 871,978, Jun. 1, 1986, abandoned.

[51] Int. Cl.[4] ..... C10C 1/00; C10C 3/00

[52] U.S. Cl. ..... 208/39; 208/22; 208/44

[58] Field of Search ..... 208/39, 40, 22; 210/800, 808

[56] References Cited

U.S. PATENT DOCUMENTS

| | | | |
|---|---|---|---|
| 4,454,019 | 6/1984 | Izumi et al. | 208/22 |
| 4,469,667 | 9/1984 | Uemura | 208/22 |
| 4,488,957 | 12/1984 | Noguchi et al. | 208/39 |
| 4,511,456 | 4/1985 | Izumi | 208/39 |
| 4,512,874 | 4/1985 | Watanabe | 208/22 |
| 4,529,498 | 7/1985 | Watanabe | 208/22 |
| 4,529,499 | 7/1985 | Watanabe | 208/22 |
| 4,589,974 | 5/1986 | Izumi | 208/22 |
| 4,591,424 | 5/1986 | Comi et al. | 208/22 |
| 4,601,813 | 7/1986 | Izumi et al. | 208/39 |

FOREIGN PATENT DOCUMENTS

| | | | |
|---|---|---|---|
| 0141487 | 9/1982 | Japan | 208/39 |
| 0142974 | 8/1983 | Japan | 208/40 |
| 0180585 | 10/1983 | Japan | 208/39 |
| 0137987 | 7/1985 | Japan | 208/40 |
| 0137989 | 7/1985 | Japan | 208/40 |
| 2083492 | 3/1982 | United Kingdom | 208/22 |

*Primary Examiner*—H. M. S. Sneed
*Assistant Examiner*—Helane Myers
*Attorney, Agent, or Firm*—C. R. Schupbach

[57] ABSTRACT

A mesophase pitch suitable for carbon fiber production is produced by heat soaking a heavy aromatic hydrocarbon feedstock at conditions such that a substantial part of the feedstock is converted to mesophase pitch. The mesophase pitch is separated from the heat soaked material by settling at a pressure higher than the pressure of the heat soaking step. In one embodiment, separate mesophase pitches having different properties can be recovered from the heat soaked feedstock.

6 Claims, 2 Drawing Sheets

PRESSURE SETTLING OF MESOPHASE

PRIOR APPLICATION

This application is a continuation-in-part of application Ser. No. 871,978, filed June 1, 1986, now abandoned.

BACKGROUND OF THE INVENTION

1. Field of the Invention

This invention relates to production of mesophase pitch suitable for manufacture of carbon fibers and other carbon artifacts. More particularly, the invention is directed to an improved settling process for separating mesophase pitch from a heat soaked heavy aromatic hydrocarbon feedstock.

2. The Prior Art

There has been a substantial effort in recent years to produce anisotropic pitch comprised of from 40 to 100 percent mesophase, which can then be spun into carbon fibers. One approach to production of mesophase involves heat soaking a heavy aromatic hydrocarbon feedstock at conditions such that a more dense mesophase material forms. Variations of the heat soaking process include sparging inert gas through the feedstock during heat soaking, agitating the feedstock during heat soaking, or a combination of sparging and agitation, as described in U.S. Pat. No. 4,209,500 to Chwastiak.

U.S. Pat. No. 4,317,809 to Lewis et al. describes heat soaking a mesophase precursor material at high pressure, followed by additional heat soaking at atmosphere pressure with gas sparging.

U.S. Pat. No. 4,454,020 to Izumi et al. describes heat soaking mesophase precursor material, separating a heavier anisotropic phase, and further heating the separated portion.

U.S. Pat. No. 4,591,424 to Gomi et al. refers to the use of pressures above atmospheric for heat soaking.

European Patent Application Publication No. 44,714 describes a basic heat soak and gravity separation process for producing mesophase pitch which involves cooling the heat soaked material enough to stop boiling so that settling of mesophase pitch readily occurs.

Many other descriptions of variations of the heat soaking procedure for producing mesophase appear in the literature, and the present invention is applicable in general to any process in which a mesophase forming feedstock is heat soaked to form mesophase and the thus formed mesophase recovered from the heat soaked feedstock. Specific mesophase-forming conditions of temperature, heat soaking time, feedstock composition, gas sparging, agitation and the like have been extensively developed in the prior art, and are not a part of the present invention, as the present invention is generally applicable in any case where a mesophase-forming feedstock is heat soaked and mesophase pitch recovered therefrom, without regard to the specific conditions under which the mesophase is formed.

SUMMARY OF THE INVENTION

According to the present invention, mesophase pitch is recovered from a heat soaked mesophase precursor feedstock by applying a pressure higher than the heat soaking pressure to the heat soaked material, allowing more dense mesophase material to settle by gravity, and separating the settled material from the less dense heat soaked material.

The settling temperature can be the same as or lower than the heat soaking temperature, but should not be low enough that increased viscosity substantially impedes settling.

During the heat soaking stage, the feedstock undergoes cracking reactions leading to production of mesophase and other components, including gaseous components. These gaseous cracking components continue to evolve during the settling step, if settling is conducted at or near the heat soaking temperature, resulting in agitation of the material to be settled.

EPA Publication No. 44,714, referred to earlier, attempts to overcome this problem by cooling the heat soaked material to reduce gas evolution from cracking, as well as boiling of the material, such that settling is not hindered by gas movement through the settling material. This technique is subject to the drawback of increased viscosity with decreasing temperature, such that the time required for settling is increased.

According to the present invention, an increased pressure is applied to the heat soaked material, sufficient to prevent or reduce boiling and to substantially maintain cracked gaseous components in solution, such that the settling occurs without the necessity of a viscosity-increasing cooling step. Such pressure increases are most effective if applied for a short time period usually ranging up to about 15 minutes, most preferably at about 5 minutes.

It is an object of the invention to provide a process for rapidly settling mesophase pitch from heat soaked mesophase precursor.

It is a further object to provide a process for controlling certain characteristics of mesophase pitch which is separated from a heat soaked mesophase precursor.

The above as well as additional objects and advantages are obtained by the present invention, as will be apparent from the following detailed description.

THE DRAWINGS

DESCRIPTION OF THE PREFERRED EMBODIMENTS

The term "mesophase" as used herein refers to an optically anisotropic material formed by any of several variations of a process in which a heavy aromatic hydrocarbon feedstock is heat soaked at conditions known in the art to produce a substantial amount of the optically anisotropic mesophase material.

Heavy aromatic hydrocarbon feedstocks suitable for formation of mesophase are also known in the art, and include, among others, petroleum pitch, decant oil and thermal tar.

Figure 1:
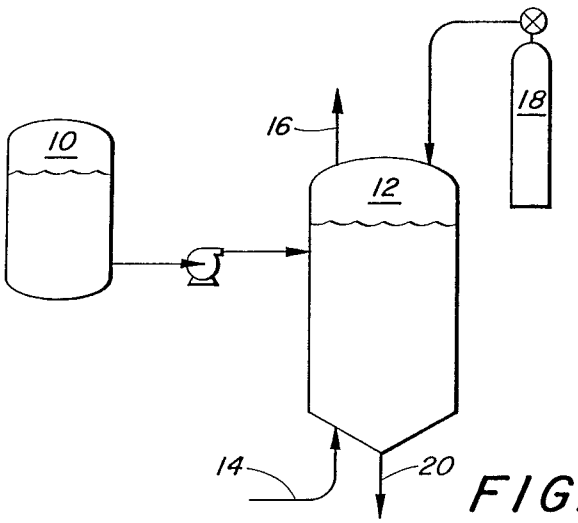
FIG. 1 is a schematic flowchart showing a batch type process in accordance with the invention.

A basic batch type version of the process of the invention is illustrated in FIG. 1, where heavy aromatic hydrocarbon feedstock from tank 10 is pumped to heat soak vessel 12 where it is heated by any suitable means (not shown) until a substantial amount of mesophase has formed. During all or part of the heating, an inert sparge gas from line 14 may be sparged through the feedstock to remove lighter hydrocarbon components and to effect more efficient heat transfer. The sparging gas exits through line 16.

When the heat soak is completed, flow of sparging gas is stopped, the soak tank 12 is sealed, and soak tank 12 is then pressurized by gas from cylinder 18 to a pressure sufficient to prevent boiling of the contents and to maintain cracked gases in solution. With the system closed in and no appreciable gas movement through the heat soaked material, the more dense mesophase readily settles to the bottom of tank 12, and is withdrawn through mesophase recovery line 20.

Figure 2:
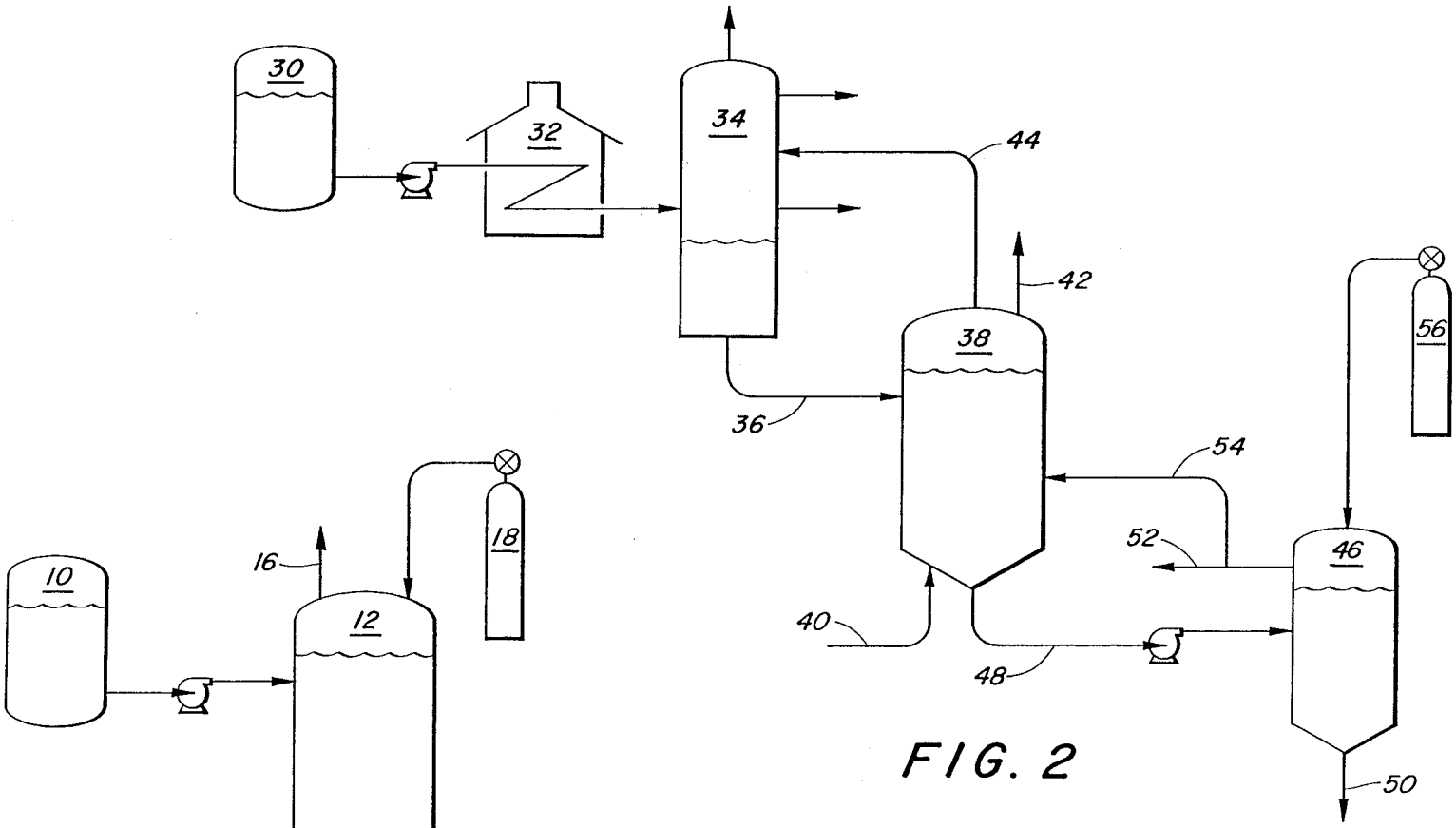
FIG. 2 is a schematic flowchart showing a continuous type process in accordance with the invention.

A basic continuous type version of the process of the invention is illustrated in FIG. 2, where feedstock from tank 30 is heated in heater 32 and passed to distillation or flash tower 34. The tower bottoms are fed through line 36 to soak tank 38, and sparge gas may be passed through the soak tank 38 via lines 40 and 42. If sparge gas is not used, vapors from tank 38 may be returned to tower 34 via line 44. Soak tank 38 may have internal baffles (not shown) or other flow control means to assure uniform residence time of the feedstock in tank 38. The heat soaked material from soak tank 38 is passed to settling tank 46 via line 48. Settling tank 46 may also include internals (not shown) to assure appropriate residence time and to direct settled mesophase to mesophase recovery line 50. The non-mesophase material may be removed from settling tank 46 via line 52, or recycled to soak tank 38 via line 54. An increased pressure in settling tank 46 may be maintained by gas pressure from gas cylinder 56.

Figure 3:
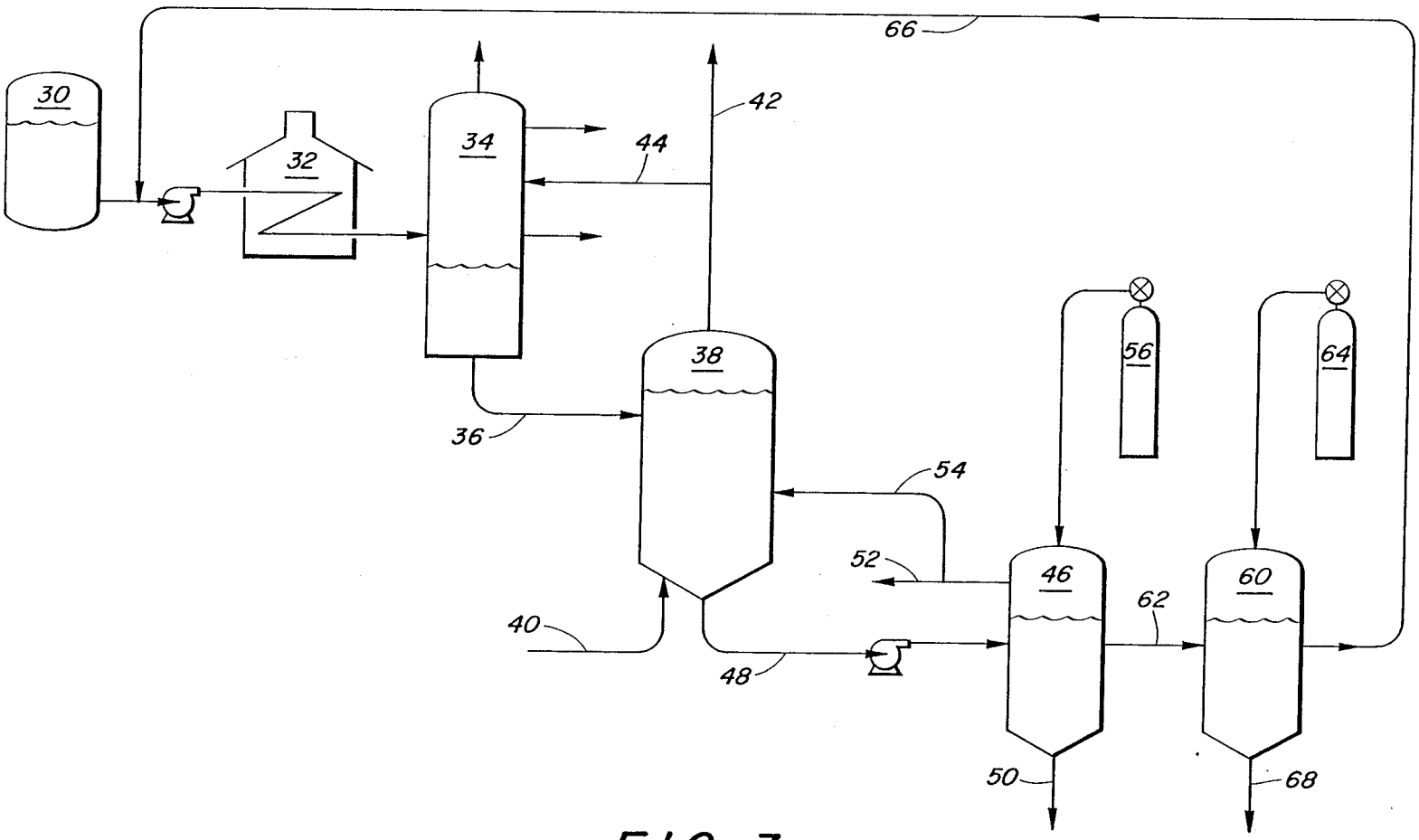
FIG. 3 is a schematic flowchart showing another variation of a continuous type process in accordance with the invention.

A more elaborate continuous type version of the process of the invention in which two different mesophase products are recovered is illustrated in FIG. 3. The system depicted in FIG. 3 is similar to the FIG. 2 version, but includes a second settling tank 60 which is fed with non-mesophase material from first settling tank 46 via line 62. Second settling tank 60 normally is maintained at a lower temperature and pressure than first settling tank 46. Pressure in tank 60 may be controlled with gas cylinder 64, and unsettled material may be returned to heater 32 via recycle line 66. Settled mesophase from tank 60 is recovered via line 68. Elements of FIG. 3 which are common with FIG. 2 have like identification numbers.

Temperature is an important variable during pressure settling due to the strong temperature dependence of the solubility of mesophase in isotropic heavy aromatic pitch. Decreased settling temperature increases the yield of mesophase while lowering its average molecular weight. Through proper temperature control, two distinct types of mesophase pitch or blends thereof can be isolated. Settling at or near the soaking temperature yields a relatively high melting, highly coalesced mesophase pitch. This material is almost entirely comprised of anisotropic mesophase. Subsequent cooling of the saturated heat soaked feedstock leads to precipitation and settling of "new" lower melting mesophase pitch which is less highly coalesced. This lower melting mesophase pitch is generally 50 to 90 weight percent anisotropic material.

Thus, the embodiment illustrated in FIG. 3 enables a "tailoring" of mesophase product which is not possible in a single settling step operation.

EXAMPLE 1

A series of batch autoclave runs were made using pitch obtained from Ashland Oil Co. (Ashland A240 pitch). The pitch was heat soaked 9¾ hours at 800° F. (427° C.). Variables in the runs were soak pressure (0 or 50 psig), pressure increase at the end of the heat soak (10 or 40 psig) and settling time at the increased pressure (5 or 20 minutes). Of the examples carried out, examples 4, 5 and 7 illustrate the present invention, and demonstrate that both pressure increase over soak pressure and length of time of such pressure increase are necessary. Settling is indicated by higher toluene insolubles in the bottom versus the top of the product.

Pressure settling conditions and product properties are summarized in Table 1. Toluene insoluble differences between the upper and lower portion of the products were used as a measure of settling. Insoluble differences varied from 0.2 to 10.0 percent. The average change in insolubles for various run conditions was determined to illustrate the conditions which provided the greatest desirable changes (Table 2). Results show a benefit from a short settling time and from a high pressure change.

The results obtained are believed to occur because, while mesophase tends to settle relative to isotropic pitch, a stable foam can form which tends to float, such floating effects dominating over settling effects. The foam is collapsed by higher pressures (at least 30 kPa over foam-forming soak temperatures) and allows settling at increased rates.

The use of temperature in conjunction with pressure allows mesophase compositions produced for specific uses to be recovered more quickly and economically.

Time is also an important factor in the present invention. Settling time at increased pressure must be chosen to complete settling before thermal reactions saturate the liquid with gas, causing boiling to resume and preventing settling. Best results are obtained at about five minutes near heat soak temperatures. Mesophase settling occurs rapidly in the hot, non-viscous mixture, even though isotropic/mesophase gravity difference is usually less than 0.1 gram/cc.

Geometry of the vessel is an important, but not critical factor. Best results are obtained from vessels having a height equal to about the circumference of the vessel. In extremely tall vessels, the use of baffles can overcome deficiencies, or liquid levels can be lowered to optimize settling.

TABLE 1

PRESSURE SETTLING RUNS

| | Run Conditions | | | | | Products | | |
|---|---|---|---|---|---|---|---|---|
| | Heat Soak | | Settling | | | Toluene Insolubles, % | | |
| Example No. | Time, hr. | Pressure, psig | Pressure Increase, psig | Time, min. | Residue Yield, % | Top | Bottom | Delta Bottom-Top |
| 1 | 9.75 | 0 | 40 | 20 | 71 | 88.6 | 90.2 | 1.6 |
| 2 | 9.75 | 0 | 10 | 20 | 72 | 88.3 | 90.1 | 1.8 |
| 3 | 9.75 | 50 | 40 | 20 | 87 | 76.0 | 76.2 | 0.2 |
| 4 | 9.75 | 50 | 40 | 5 | 92 | 70.0 | 80.0 | 10.0 |
| 5 | 9.75 | 0 | 40 | 5 | 74 | 84.1 | 88.6 | 4.5 |

TABLE 1-continued

PRESSURE SETTLING RUNS

| | Run Conditions | | | | | Products | | |
|---|---|---|---|---|---|---|---|---|
| | Heat Soak | | Settling | | | Toluene Insolubles, % | | |
| Example No. | Time, hr. | Pressure, psig | Pressure Increase, psig | Time, min. | Residue Yield, % | Top | Bottom | Delta Bottom-Top |
| 6 | 9.75 | 50 | 10 | 5 | 87 | 73.6 | 75.9 | 2.3 |
| 7 | 9.75 | 0 | 10 | 5 | 74 | 84.6 | 90.2 | 5.6 |
| 8 | 9.75 | 50 | 10 | 20 | 87 | 75.5 | 76.6 | 1.1 |

TABLE 2

ANALYSIS OF PRESSURE SETTLING TOLUENE INSOLUBLES DATA

| Run Condition | Avg. Bottom. Top Insol., % | Δ Bot. - Top % Insol. per Condition Δ Condition |
|---|---|---|
| Soak Pressure | | |
| 0 psig | 3.38 | 0.02 |
| 50 psig | 3.40 | |
| Settling Pressure Increase | | |
| 10 psig | 2.70 | 1.38 |
| 40 psig | 4.08 | |
| Settling Time | | |
| 5 min. | 5.60 | 4.42 |
| 20 min | 1.18 | |

The Table 2 data shows that soak pressure has little effect on mesophase settling. Settling pressure has a significant effect on mesophase settling, and the amount of time the pressure is applied after soak is very significant.

EXAMPLE 2

This example illustrates production of two mesophase pitch products having different properties using a process as depicted in FIG. 3.

A flashed thermal tar feedstock is heated to about 460° C. and passed to a flash tower maintained at about 375 kPa. The flash tower bottoms (deep flashed thermal tar) are passed to a heat soak tank maintained at about 375 kPa and about 440° C. Residence time of the deep flashed thermal tar in the heat soak tank is about 6 hours. Heat soaked thermal tar is pumped from the soak tank to a first settling tank maintained at about 620 kPa without substantial cooling of the heat soaked material. Residence time in the first settling tank is about 10 minutes. The increased pressure essentially prevents boiling in the settling tank, and about 35 percent by volume of the heat soaked material settles out as "old" mesophase pitch which is essentially 100 percent anisotropic material having a melting point of about 450° C. Unsettled material from the first settling tank is passed to a second settling tank maintained at a pressure of 375 kPa and a temperature of about 250° C. with a residence time of about 20 minutes. A "new" mesophase pitch in an amount of about 50 percent of the feed to the second settling tank, comprising about 75 percent anisotropic material and having a melting point of about 200° C., is recovered. Unsettled material from the second settling tank is recycled to the heater feed.

This example illustrates that high melting mesophase can be quickly settled from heat soaked feedstock using an increased pressure, and a low melting mesophase can be precipitated from the remaining saturated heat soaked material.

There are many variations and embodiments of the invention which will be apparent to those skilled in the art of making mesophase. Directionally, much is known as to the effects of varying such things as feedstock, soaking time and temperature, sparging, agitation, cooling of soaked feedstock, and the like. Soaking temperatures of from 350° to 475° C. and soaking times of from 0.5 to 120 hours are generally considered to be the practical limit for the process, with shorter times within that range generally being used with temperatures nearer the higher limit. The conditions for a particular run may be influenced by factors such as time available, feedstock properties, equipment limitations, desired product properties, etc., as is known in the art. However, the prior art has not recognized that rapid settling can be effected by increasing pressure on a heat soaked mesophase-containing feedstock for a short period of time, and further has not recognized that rapid initial settling of mesophase made possible by use of increased settling pressure for a short time, about five minutes provides a capability for producing mesophase pitches having specific desired properties such as low melting point.

The essential novel feature which permeates all the embodiments of the invention is the use of an initial settling pressure for a short time greater than the pressure at which the feedstock was heat soaked. The heat soaking pressure can be higher, lowr or equal to atmospheric pressure, and the settling pressure needs to be sufficiently higher than the soaking pressure to retard or eliminate boiling in the soak tank and to keep in solution any gases generated by cracking after the soaking is completed. The time of increased pressure is effective is generally that before boiling resumes. A pressure as little as 30 kPa (1 Pa$=1.45\times10^{-4}$ lb/in$^2$) above the soaking pressure can be effective in some cases, and in other cases it may be desirable to use a pressure as much as 2 MPa higher than the soaking pressure.

I claim:

1. In a process for producing mesophase pitch wherein a heavy aromatic hydrocarbon feedstock is heat soaked at a first pressure until a substantial portion of the feedstock has been converted to optically anisotropic material, and in which mesophase pitch is recovered from the heat soaked material by gravity settling, the improvement comprises:

subjecting and maintaining for a time of up to about 15 minutes said heat soaked material, prior to recovery of mesophase pitch therefrom, to a second pressure which is at least 30 kPa higher than said first pressure for a time of up to about 15 minutes, whereby boiling of the heat soaked material is reduced and settling of mesophase pitch is enhanced.

2. The process of claim 1 wherein said heat soaked material is retained in a heat soaking vessel, and said second pressure is applied to said vessel prior to recovery of settled mesophase pitch therefrom.

3. The process of claim 1 wherein said heat soaked material is transferred from a heat soaking vessel to a settling vessel maintained at said second pressure, and mesophase pitch is recovered from said settling vessel.

4. The process of claim 3 wherein the remaining heat soaked material in said settling vessel, after recovery of mesophase pitch therefrom, is returned to said heat soaking vessel and further heat soaked.

5. The process of claim 3 wherein the remaining heat soaked material in said settling vessel, after recovery of mesophase pitch therefrom, is transferred to a second settling vessel from which additional settled mesophase pitch is recovered.

6. A process for producing mesophase pitch comprising:

(a) heat soaking a heavy aromatic hydrocarbon feedstock at a temperature of from 350° to 475° C. for a time of from 0.5 to 120 hours and at a first pressure until a substantial portion of said feedstock has been converted to mesophase pitch;

(b) subjecting said heat soaked feedstock containing mesophase pitch to a second pressure which is at least 30 kPa higher than said first pressure;

(c) maintaining said heat soaked feedstock at said second pressure for a time of up to about 15 minutes while mesophse pitch settles therefrom; and (d) recovering said settled mesophase pitch.

* * * * *